US006315523B1

(12) United States Patent
Mills

(10) Patent No.: US 6,315,523 B1
(45) Date of Patent: Nov. 13, 2001

(54) ELECTRICALLY ISOLATED PUMP-OFF CONTROLLER

(75) Inventor: Manuel D. Mills, Midland, TX (US)

(73) Assignee: DJAX Corporation, Midland, TX (US)

( * ) Notice: Subject to any disclaimer, the term of this patent is extended or adjusted under 35 U.S.C. 154(b) by 0 days.

(21) Appl. No.: 09/507,772

(22) Filed: Feb. 18, 2000

(51) Int. Cl.[7] ..... F04B 49/06

(52) U.S. Cl. ..... 417/45; 417/53; 318/430; 307/150

(58) Field of Search ..... 417/45, 44.1, 53; 318/430; 307/31, 32, 150

(56) References Cited

U.S. PATENT DOCUMENTS 3,953,777 * 4/1976 McKee ..... 417/45
3,998,568 * 12/1976 Hynd ..... 417/45
4,102,394 * 7/1978 Botts ..... 417/45
4,145,161 * 3/1979 Skinner ..... 417/45
4,194,393 * 3/1980 Boley ..... 417/44.1
4,508,488 * 4/1985 Pikna ..... 417/44.1
4,509,901 * 4/1985 McTamaney et al. ..... 417/53
4,595,343 * 6/1986 Thompson et al. ..... 417/53
5,044,888 * 9/1991 Hester, II ..... 417/45
5,230,607 * 7/1993 Mann ..... 417/44.1

* cited by examiner

*Primary Examiner*—Cheryl J. Tyler
(74) *Attorney, Agent, or Firm*—Browning Bushman

(57) ABSTRACT

Electrical isolation method and assembly that protects a pump-off controller 31 as used for controlling the pumping of a subterranean well, from lightning and transient electrical power surges by electrically isolating the pump-off controller 31, the isolation assembly including fiber optic cables 17, 18, signal converters to convert electrical signals to optical signals 25, 33, signal converters to convert optical signals to electrical signals 32, 19 and a solar panel 35 to power the pump-off controller 31. Components of the fiber optic and control assembly may also be electrically protected from lightning and electrical power transients by including an isolation transformer 53, components to drive the isolation transformer 53, metal oxide varisters, fuses and other protection devices. Signals from the pump-off controller 31 may be used to stop/start a prime mover 45 for a pumping unit 46, or regulate the speed of the prime mover 45.

22 Claims, 2 Drawing Sheets

ELECTRICALLY ISOLATED PUMP-OFF CONTROLLER

FIELD OF THE INVENTION

The present invention relates generally to a pump-off controller as may be used to control the pumping of fluid from subterranean wells. More specifically, this invention relates to a pump-off controller which may be electrically isolated from the motor control panel by using fiber optic connectivity, thereby improving the quality of electrical insulation from lightning strikes and other electrical transients.

BACKGROUND OF THE INVENTION

Pump-off controllers have been commonly used in the upstream oil and gas industry to control the pumping of oil and gas wells, particularly on fluid producing wells wherein the pumping equipment is capable of lifting more fluid from the wellbore than the formation is capable of producing into the wellbore. The most common prime mover on a pumping unit is an electrical motor. To control the pumping of a well, the electric motor may be stopped, started, sped up or slowed down.

A pumping system on a well may include a beam type pumping unit, a prime mover, a power source, a motor control panel, a pump-off controller (POC) and POC control panel, rods, production tubing, downhole pump and a pumping type wellhead assembly. At some point in the life of a pumping system, the pumping system capacity may substantially exceed the productivity of the well. When the outflow capacity of the pumping equipment or artificial lift equipment exceeds the inflow capacity of the reservoir to the well, to prevent excessive wear and damage to the pumping equipment due to the partially filled pump and to save electricity, a well may be pumped for a first interval of time and then shut down for a second interval of time to allow the wellbore to fill with fluid. One method of effecting this interval pumping technique is with a time clock type device. When the fluid column in the wellbore builds, the inflow from the reservoir slows and eventually ceases when the pressure at the formation face in the wellbore equals the formation pressure. It is then desirable to turn the pumping unit back on to pump the produced fluid from the wellbore and then repeat the process.

In order to maximize the production rate from a well, there is usually an optimum time at which to turn the pumping unit back on prior to complete cessation of inflow. It may be difficult to determine exactly when all of the fluid has been pumped from the wellbore in order to timely shut down the pumping unit to avoid excessive equipment wear and energy consumption. Also, as wells are produced, the inflow conditions may change over time, particularly early in the life of a new well, or when utilizing a secondary or tertiary recovery mechanism such as waterflooding. For these and other reasons, pump-off controllers are typically employed on pumping units to improve the efficiency, productivity and life of the pumping system.

Pump-off controllers (POC) typically operate to determine the appropriate time to turn a pumping unit on, when to turn it off, how long to wait before turning the unit back on and then restarting the unit to repeat the cycle. They may also monitor pumping parameters for fault conditions. POC's may function by measuring the changes or absolute values of time cycles such as stroke speed, loading on various components such as the polished rod, electrical system changes such as motor current and/or a combination of other measurements related to these components. Other pump-off controllers may function to control the pumping unit by comparing the integrated area in the curve of a plot of predicted load vs. polished rod position, to the integrated area in the curve of a plot of measured load vs. polished rod position.

POC measuring and data inputs and outputs are conventionally hard wired to the pumping unit motor control panel, with the POC typically residing in a separate control panel. Analog and/or digital transducers or measuring end devices may be connected on one end to the pumping unit and on the other end to the motor control panel and/or connected directly to the POC panel. The POC may be powered by an electric line from the motor control panel running to the pump-off control panel or it may be powered by a solar panel. POCs also typically have a battery for back-up power in the event of primary electrical power failure.

Typically, electrical components in a pumping system are connected with electrically conductive wire. A drawback to this type connectivity is that when transients, induced currents, switching surges, power feeder surges, over-loads, short circuits, static discharges or lightening strikes hit one component in the system, all components are at risk of damage from the current surge. To combat this problem, lightening protection, surge suppression, fuses, over-load switches and other protection equipment may be employed. These protection systems are not fool-proof in that a misapplication or improper design may result in little or no protection and thereby result in damaged or destroyed devices. Poor electrical grounding may also result in ineffective device protection.

Damage to circuitry in a POC may result in relatively expensive costs due to direct loss and replacement of equipment. Additional losses may be incurred due to lost production from downtime due to the equipment failures and/or operation of partially filled pumping equipment resulting in damaged pumping equipment and wasted energy.

An improved method of isolating a POC is desired in order to reduce the risk of damage or destruction of POC's and related equipment. The disadvantages of prior art are overcome by the present invention and an improved method of connecting and protecting POC installations and related equipment are hereinafter disclosed.

SUMMARY OF THE INVENTION

A suitable embodiment of components and methods for controlling the operation of a prime mover on a pumping unit for lifting fluid from a well and electrically isolating a pump-off controller (POC) in a pumping system from other components of the pumping system, is illustrated in FIG. 1. FIG. 1 illustrates the employment of fiber optics and related components to facilitate a non-electrically conductive communications link between the POC and other power and control components of the pumping system. A suitable embodiment of a pumping system, power and control assembly, including related circuits, transformers and other components, is illustrated in FIG. 2.

A power and control assembly for electrically isolating the POC with fiber optics is provided by this invention. Fiber optics may generally facilitate communication and transmission of data and signals between the POC and related power and control components. Preferably, as generally illustrated in FIG. 2, the high voltage power and motor control components and a portion of the lower voltage control components may be located in a common panel box, which may be referred to as a motor control panel. The POC and components related to communication with the POC may be located substantially in a second panel box, which may be referred to as a pump-off control panel box. Within the motor control panel and/or the pump-off control panel, power and control components may also generally be located on a common circuit board or on multiple boards, and may be positioned in various arrangements or in multiple locations.

In a preferred embodiment, the power and control components may include a first high voltage power source to provide power to the prime mover and related higher voltage components. Power to the operate and control the lower voltage components, including control, sensing, measuring, recording, converting and other lower voltage components, may be provided through one or more transformers as appropriate to provide the desired voltages. These transformers may typically be connected to single phases, but may also be connected to multiple phases. The power and control assembly may also include current, voltage and lightning protection features and components such as fiber optics, fuses, disconnects, inductive electrical connections, electrical isolation transformers, varisters connected to electrical grounds and other related components. In one embodiment, power to operate the POC and charge a battery for back-up power to the POC may be provided by a solar panel, thereby providing additional electrical isolation of the POC from other components of the pumping system. Pumping system components such as a pumping unit or elevated electrical power-lines may be subject to relatively frequent and intense lightning strikes and other electrical transients, which may damage electrical components, including relatively costly POCs.

In the embodiment as illustrated in FIG. 2, electrical transient and lightning protection may be included on the primary and/or the secondary side of a transformer which may be used to transform a high voltage power to a lower voltage power. This protection may include one or more metal oxide varisters (MOVs). As used herein, the terms electrical protection or electrical protector may include any type of electrical protector, including lightning protection devices and techniques, surge suppression components, fuses, over-load switches, MOVs or any other known electrical current or voltage protection device.

Fiber optic cables and optical transducers are employed by this invention to substantially electrically isolate the motor control panel from the pump-off control panel, or minimize the number of electrical conductors between the same. In addition, an isolation transformer may be provided to substantially electrically isolate control components in the motor control panel from a sensor or measuring device. This invention discloses additional related components in a preferred embodiment and alternative embodiments which may drive the isolation transformer, sensor, motor contactors and fiber optic components. These related components may include components which may transform voltages, rectify substantially AC currents to substantially DC currents, convert substantially DC currents to AC currents, amplify signals, transduce electrical signals to optical signals, transduce optical signals to electrical signals, boost or drop current and/or voltage, regulate voltage and provide electrical protection and grounding.

It is an objective of the present invention to substantially electrically isolate the POC from components in the motor control panel by minimizing or eliminating electrically conductive wiring between the POC and the components in the motor control panel and replacing that wiring with fiber optic connections.

It is also an objective of the present invention to provide a relatively simple and highly reliable method of transmitting information and signals between the POC and motor controls.

It is a further objective of this present invention to provide a reliable and cost effective circuit to connect, control and/or communicate with any of a number of digital or analogue end devices or components related to pumping systems, including prime movers, fluid pumps, valves or regulators on surface production equipment and facilities or remote telemetry systems such as field wide POC systems.

It is also an object of this invention for the invention to be applicable to installations utilizing on-off control of a prime mover, as well as varying the speed of a prime mover. On-off control will generally be most applicable to installations involving an electric motor type prime mover. Installations requiring varying the speed of the prime mover may generally be most applicable to pumping installations which may include a gas engine prime mover, whereby the engine may be throttled such as with a solenoid. Other installations whereby the speed may be varied might include variable speed drives, such as on electrical submersible pump installations or progressive cavity pump installations.

A feature of the present invention is that fiber optic connections and related equipment may be used to transmit and receive digital, analogue and/or discrete control and/or information signals between multiple components of the pumping system, including for example, the pumping unit, prime mover, motor control panel, POC, pumping timers and communications and control devices such as radios, programmable controllers, safety and environmental monitoring equipment and other devices or components.

Another feature of the present invention is that the fiber optic connection provides a method of electrically isolating electrical components in a pumping system. This is facilitated in the present invention with fiber optics, isolation transformers and MOVs.

These and further objects, features and advantages of the present invention will become apparent from the following detailed description, wherein reference is made to the figures in the accompanying drawings.

DETAILED DESCRIPTION OF THE PREFERRED EMBODIMENTS

Figure 1:
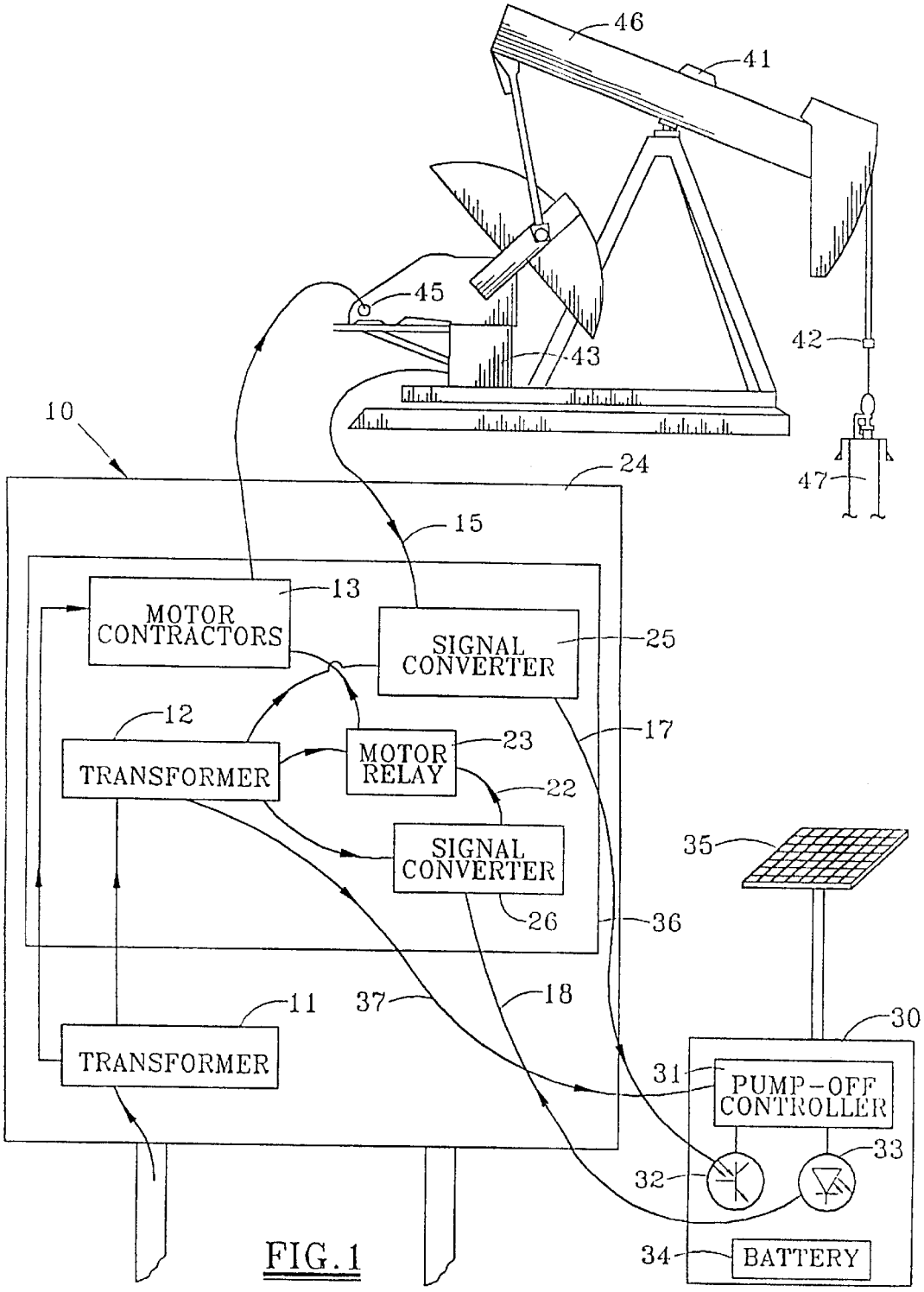
FIG. 1 is an illustration of surface components of a typical pumping system according to the present invention, including a pumping unit, a motor control panel box and related components, a pump-off control panel box, a solar panel and electrical connections.
Figure 2:
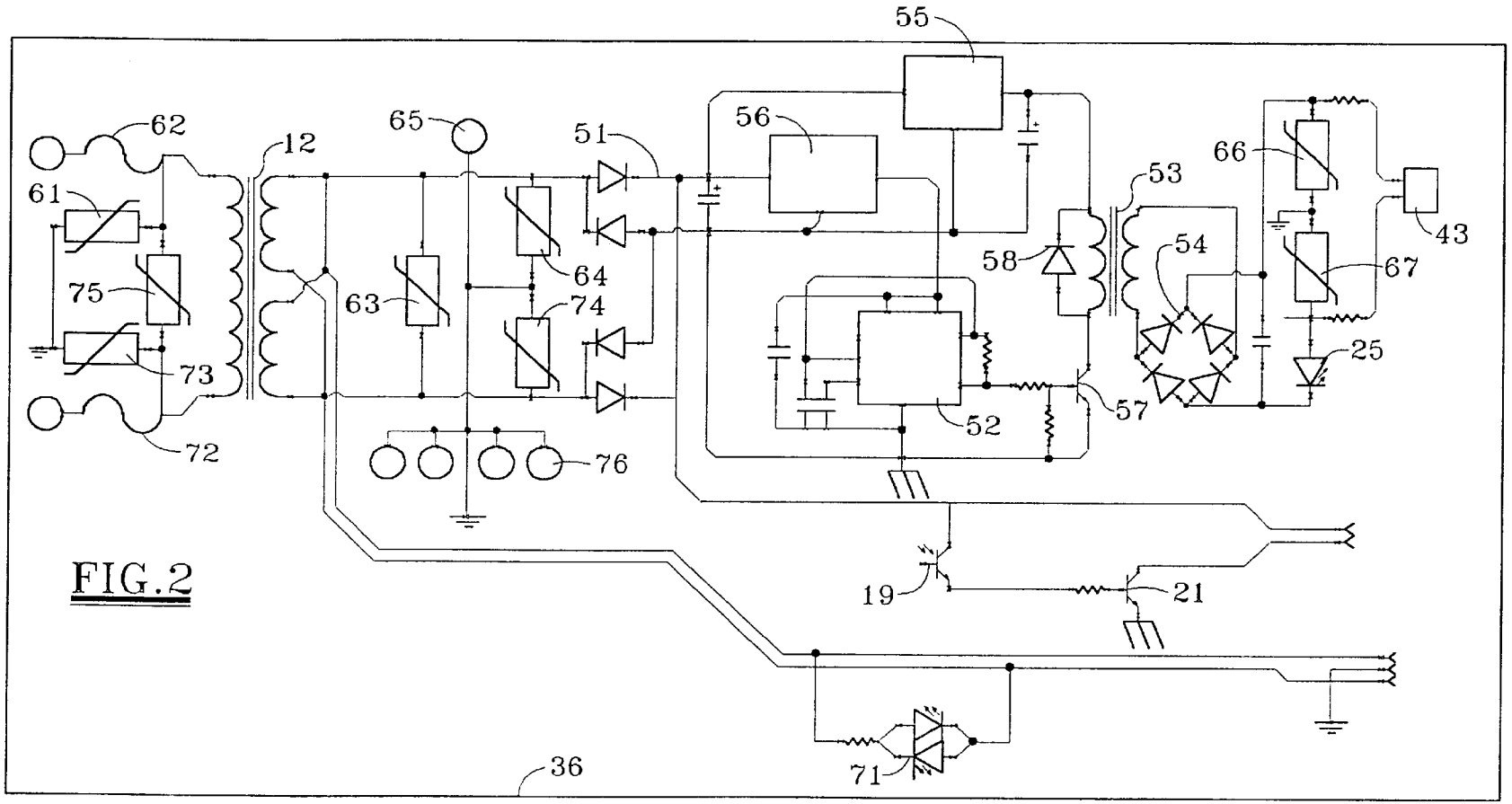
FIG. 2 is a schematic illustration of a preferred embodiment of a circuit including a power source, converters, an oscillator circuit and an isolation transformer and related circuits and components of a power board.

FIGS. 1 and 2 illustrate a suitable application for a fiber optically connected pump-off controller according to the present invention. A motor control panel 10 may be provided a relatively high voltage AC power supply. The motor control panel 10 may include means for (a) transmitting and selectively interrupting the high voltage AC power supply to the prime mover 45, and (b) transforming a portion of the high voltage AC power supply to reduced voltages for use by control equipment or other related applications in the pumping system. A pumping system may be defined as including all components related to the pumping of fluids from a wellbore, such as the pumping unit 46, the prime mover 45, the motor control panel 10, pump-off control panel 30 and related downhole equipment.

The motor control panel 10 may include one or more transformers 11, 12, one or more motor contactors 13, a signal converter circuit 25, another signal converter circuit 26, a motor relay 23 and other related components. The pump-off control panel 30 may include a pump-off controller 31, signal converters 32, 33, a battery 34 and other related components. Each control panel 10, 30 may be provided with separate sources of electrical power.

The high voltage portion of power in the motor control panel may be interrupted, either automatically, such as by a pump-off controller 30 or manually, such as by a switch, thereby interrupting the power supply to the prime mover and ceasing the pumping of fluids from the wellbore 47. The low voltage portion may be used to monitor pumping conditions related to fluids in the wellbore 47, characteristics of the pumping unit 46, characteristics of the prime mover 45, or other characteristics related to the pumping system.

In a preferred embodiment as illustrated in FIGS. 1 and 2, a first transformer 11 may transform a portion of the high voltage power source to a useable reduced voltage or first low voltage, as for example transforming from 440 volts AC to 120 volts AC. This lower voltage may be useful as in powering a radio, power receptacle outlet or control components of the pumping system. In a preferred embodiment, a portion of the first low voltage may be further transformed by a second transformer 12 to a second low voltage, as for example from 120 volts AC to 12 volts AC. In alternative embodiments, only one voltage transformation may be required, though multiple voltage transformations may be preferred.

An appropriate low voltage may be used to provide power for analog and/or digital sensors, measuring devices and/or recorders which may sense, measure or record various operating characteristics of the pumping system, including for example a Reed switch, position sensor, beam transducer, polished rod load cell, flow-line pressure switch or any other such device. Operating characteristics of interest for recording, measuring or sensing may include pumping speed, structural loading on the pumping unit, loading on the rod string, tubing pressure, motor current, motor voltage or pumping unit stroke position. The term sensor 43 may be used herein to collectively refer to any such device which may sense, measure or record operating system characteristics of any component in a pumping system. The sensor 43 may include a beam transducer 41 or potentiometer, a polished rod load cell 42, a crank-arm rotation timing sensor such as a Reed switch 43, a prime mover voltage and/or current measuring device (not shown), a crank-arm positioner (not shown) or any other device which may be capable of measuring, recording or sensing pumping system characteristics. Sensors 43 may typically be powered by or transmit relatively low power signals, as for example 12 volt signals or four to twenty milli-amp signals. Signals from a sensor 43 may ultimately be connected to a pump-off controller 31, the pump-off controller 31 having a processor for processing and evaluation of pumping system characteristics. The pump-off controller 31 may also generate a responsive signal which may ultimately be used to switch the power to the prime mover 45 on or off. The pump-off controller 31 may thereby control the pumping action of the pumping system.

To provide electrical isolation between the pump-off controller 31 and other components of the pumping system, a fiber optic cable system may be provided to partially transmit signals or data between a sensor 43 and a pump-off controller 31. The fiber optic electrical isolation may prevent lightning and/or transient voltage or current surges initiated in or transmitted through other components of the pumping system from damaging the generally relatively expensive pump-off controller 31.

In a preferred embodiment of a fiber optically isolated pump-off controller installation and referring to FIGS. 1 and 2, the electrical power supplied to a sensor 43 or other measuring or recording device may facilitate transmission of an electrical first signal along an electrically conductive flow path 15 from the sensor 43 to a first fiber optic signal converter 25. The first fiber optic signal converter 25 may be located in the motor control panel 10. The first fiber optic signal converter 25 may function as a transducer to convert the electrical first signal into an optical second signal. The optical second signal may be transmitted to the motor control panel 10 along a first fiber optic cable 17, to a second fiber optic signal converter 32. The second fiber optic signal converter 32 may be located in the pump-off control panel 30. The second fiber optic signal converter 32 may function as a transducer and convert the optical second signal to an electrical third signal.

The electrical third signal may be transmitted from the second fiber optic signal converter 32 to a signal processor such as a pump-off controller 31. The pump-off controller 31 may evaluate the electrical third signal and determine the appropriate time to change pumping conditions, such as turning an operating well off, at which time the pump-off controller may generate a electrical fourth signal. The pump-off controller 31 may transmit the electrical fourth signal to a third fiber optic signal converter 33. The third fiber optic signal converter 33 may be located in the pump-off control panel 30 and may also function as a transducer to convert the electrical fourth signal to an optical fifth signal.

The optical fifth signal may be transmitted along a second fiber optic cable 18 to a fourth fiber optic signal converter 19, which may be located in the motor control panel 10. The fourth fiber optic signal converter 19 may act as a transducer and convert the optical fifth signal to an electrical sixth signal. The electrical sixth signal may be transmitted to an amplifier 21 to boost a relatively weak electrical sixth signal to a stronger electrical seventh signal. The stronger electrical seventh signal may be transmitted to a motor relay 23 along an electrically conductive flow path 22. The motor relay 23 may then further boost and convert the electrical seventh signal to a more powerful electrical eighth signal. The electrical eighth signal may be transmitted along an electrically conductive flow path 24 to at least one motor contactor 13 to selectively engage the contactor to complete the high voltage AC power circuit providing high voltage AC power to the prime mover 45, causing the pumping system to commence pumping. Alternatively, the electrical eighth signal may cause the motor contactor 13 to selectively disengage, thereby interrupting the high voltage AC power to the prime mover 45 and causing the pumping system to cease pumping.

In a preferred embodiment, electrical isolation may also be provided between an appropriate low voltage power source which ultimately provides power to the sensors 41,42 and 43. Electrical power may be provided from a high voltage AC power source which may be transformed to the appropriate low voltage AC power. This low voltage AC power may be electrically isolated from the sensor 43 by an isolation transformer 53 which may be electrically provided in the electrical circuit between the low voltage power source and the sensor 43. In addition, electrical isolation may also be provided between the low voltage power source which ultimately provides power to the sensor 43 and the signal converter 25.

The low voltage AC power may also be referred to as a first substantially low voltage AC current. In a preferred embodiment, the first substantially low voltage AC current may be rectified by a bridge rectifier 51 to a first substantially DC current. The first substantially DC current may then drive an oscillator 52 in order that the oscillator 52 generate a second substantially AC current to drive a primary side of the isolation transformer 53. The primary side of the isolation transformer may be in parallel with a diode 58. A first voltage regulator 56 may be employed to stabilize voltage in the oscillator 52, while a second voltage regulator 55 may be employed to stabilize voltage in the isolation transformer 53. An amplifier 57 may be included to amplify the second substantially AC current generated by the oscillator in the primary side of the isolation transformer 53.

The isolation transformer 53 may substantially replicate the second substantially AC current in the primary side of the isolation transformer as a third substantially AC current in the secondary side of the isolation transformer 53. The third substantially AC current may be rectified to produce a second substantially DC current in the sensor 43, providing substantially DC power for generation of analog or digital signals in the sensor 43. The signal generated in the sensor 43 may be transmitted as an electrical first signal to the first signal converter 25.

Preferred embodiments may also include additional lightning protection, including one or more metal oxide varisters (MOVs), surge suppressors, fuses, circuit breakers, additional grounding and other electrical protection equipment. FIG. 2 illustrates one or more fuses 62 and/or one or more MOVs 61 electrically between a relatively high voltage AC power source and a transformer 12 which may transform the relatively high voltage power to a low voltage power. These MOVs 61 may be electrically grounded directly to earth. Grounding directly to earth may include electrically grounding directly to wellbore casing or a wellhead. In addition, one or more MOVs 63, 64, 74 may be provided electrically between the transformer 12 which transforms a relatively high voltage AC power source to a relatively low voltage AC power source and a first bridge rectifier 51. These one or more MOVs 63,64, 74 may be preferably grounded directly to metal grounding lugs 65, 76 placed in the metal panel, to a grounding bus or to a metal frame of the panel. The grounding lugs 65, 76 may be electrically grounded to earth. One or more MOVs 66, 67 may also be provided electrically between the sensor 43 and the second bridge rectifier 54 to protect the oscillator from electrical surges or lightning emanating from the sensor 43. These one or more MOVs 66, 67 may also be electrically grounded directly to earth.

Preferred embodiments may include other related or incidental electrical components as may be necessary or helpful in effecting the desired function of components according to this invention. The related or incidental electrical components may include capacitors, resistors, diodes, transistors or other electrical components. The general function or purpose of this invention may be effected in a number of various circuit and/or component designs and concepts as will be apparent to those skilled in the art.

In a preferred embodiment, the pump-off controller 31 may be powered by a solar panel 35 which may be electrically connected to the pump-off control panel 30. The solar panel may additionally charge a battery 34 which may provide backup or standby power to the pump-off controller. This embodiment eliminates the power cable 36 between the motor control panel 10 and the pump-off control panel 30.

In an alternative embodiment of this invention, the two fiber optic cables 17, 18 may be replaced by a single fiber optic cable and related equipment, such that the single fiber optic cable transmits signals in both directions between the motor control panel 10 components and the pump-off control panel 30 components. In addition, multiple fiber optic cables may be employed to transmit signals between multiple components as desired.

In alternative embodiments, one or two of the electrical sixth, seventh or eighth signals may be omitted in effecting operation of the motor contactors. In other alternative embodiments, the amplifier 21 and/or the motor relay 23 may also be excluded. Alternative embodiments may also utilize AC and/or DC powered sensors. Embodiments utilizing AC sensors may require modifications of electrical circuitry and components as compared to the preferred embodiments.

In alternative embodiments, the pump-off controller may be powered by a low voltage electrical circuit 36 extending electrically from a low voltage power source, such as the low voltage side of a high voltage to low voltage transformer 11 or 12, in the motor control panel 10, to the pump-off controller 31 and/or the battery 34 in the pump-off control panel 30. An alternative embodiment for powering the pump-off control panel 30 from the motor control panel 10 may also include power indicator lights 71 which may demonstrate when power is provided to the pump-off control panel 30.

Alternative embodiments may also omit or electrically alter one or more of the MOVs 61, 63, 64, 73, 74, 75 fuses 62, 72 or other lightning or electrical surge suppression components. In addition, the oscillator 52 and/or voltage regulators 55, 56 may be omitted in favor of alternative electrical designs to power an isolation transformer 53, including providing an arrangement of transistors, resistors, capacitors and/or diodes. High or low voltage photo-triacs may be employed to replace many electrical components in the preferred embodiment.

In alternative embodiments, the electrical eighth signal or another signal may be utilized to speed up or slow down a pumping unit, as opposed to merely stopping or starting the pumping unit. In these embodiments, the motor control panel may include an alternate array of equipment from the array described in a preferred embodiment or one of the other alternate embodiments disclosed herein. For example, a fiber-optically isolated POC 30 may be used to speed up or slow down a gas engine prime mover, and the embodiment may not include an electrical motor relay, motor contactor, motor control panel, transformers or other components. In such embodiment, fiber optics may be used to isolate the POC from the prime mover, sensors, control or other related equipment.

An alternative embodiment may be configured for controlling the speed of a prime mover, as opposed to merely selectively switching power to the prime mover on or off. In such embodiment, the prime mover may be an electric motor which may be controlled by a variable speed drive. In other embodiments, the motor may be a gas engine, powered casing head gas from the well. In such embodiment, electric power may be supplied by an alternator or generator on the gas engine and the controller may be an electric solenoid. The electric seventh signal may ultimately control operation of the solenoid such that the solenoid may operate a throttle to slow the pumping unit down for a period of time and then increase speed again for a second period of time and repeat this iteration as determined by the POC. In alternative embodiments, the electric seventh signal may also be used to generate subsequent control or monitor signals which may ultimately be used for control and/or use in a motor relay.

Alternative embodiments may include other related or incidental electrical components as may be necessary or helpful in effecting a desired function of an alternative embodiment of this invention, including capacitors, resistors, diodes, transistors or other electrical components. Certain components may also be omitted in alternative designs. The general function or purpose of this invention may be effected in a number of various circuit and/or component designs and concepts as will be apparent to those skilled in the art.

It may be appreciated that various changes to the methods or steps herein, as well as in the details of the illustrated methods and systems may be made within the scope of the attached claims without departing from the spirit of the invention. While preferred embodiments of the present invention have been described and illustrated in detail, it is apparent that still further modifications and adaptations of the preferred embodiments will occur to those skilled in the art. However, it is to be expressly understood that such modifications and adaptations are within the spirit and scope of the present invention, which is set forth in the following claims.

What is claimed is:

1. A pump-off control assembly for controlling a prime mover powering a pumping unit of a pumping system for lifting fluids from a well, comprising:

a power source to power the prime mover;

a controller to control the power to the prime mover;

at least one sensor mounted on the pumping system for sensing operating characteristics of the pumping system and for transmitting an electrical first signal from the at least one sensor to a first signal converter;

the first signal converter converting the electrical first signal to an optical second signal;

a first fiber optic cable transmitting the optical second signal to a second signal converter;

the second signal converter converting the optical second signal into an electrical third signal;

a pump-off controller processing the electrical third signal and for outputting an electrical fourth signal to a third signal converter;

the third signal converter converting the electrical fourth signal to an optical fifth signal;

one of the first fiber optic cable and a second fiber optic cable transmitting the optical fifth signal to a fourth signal converter;

the fourth signal converter converting the optical fifth signal to an electrical sixth signal and transmitting the electrical sixth signal to an amplifier; and the amplifier amplifying the electrical sixth signal and generating an electrical seventh signal to regulate the controller.

2. The pump-off control assembly as defined in claim 1, further comprising:

the power source is a high voltage AC power source;

the controller includes a motor contactor to normally transmit the high voltage AC power to the prime mover, the contactor selectively operable to interrupt the high voltage AC power to the prime mover; and a motor relay receiving the electrical seventh signal and transmitting an electrical eighth signal to the motor contactor to selectively operate the motor contactor.

3. The pump-off control assembly as defined in claim 2, further comprising:

at least one transformer for transforming a portion of the high voltage AC power to a low voltage AC power, the low voltage AC power powering at least the amplifier.

4. The pump-off control assembly as defined in claim 3, further comprising:

a first bridge rectifier rectifying a portion of the low voltage AC power to provide a first substantially DC current to drive an oscillator;

the oscillator powered by the first substantially DC current, the oscillator to provide a substantially AC current to drive an electrical isolation transformer;

the electrical isolation transformer to electrically isolate the oscillator from the at least one sensor; and a second bridge rectifier receiving power from the electrical isolation transformer to provide a second substantially DC current to the at least one sensor.

5. The pump-off control assembly as defined in claim 4, further comprising;

at least one first voltage regulator to maintain substantially constant voltage in the oscillator; and at least one second voltage regulator to maintain substantially constant voltage in the electrical isolation transformer.

6. The pump-off control assembly as defined in claim 3, further comprising;

a motor control panel for housing the at least one transformer, the motor contactor, the first signal converter, the fourth signal converter and the motor relay.

7. The pump-off control assembly as defined in claim 3, wherein the at least one transformer comprises:

a high voltage AC transformer to transform a high voltage to a medium voltage to provide an intermediate voltage source; and a medium voltage AC transformer to transform a medium voltage to a low voltage to provide the low voltage AC power.

8. The pump-off control assembly as defined in claim 3, further comprising:

at least one circuit overload protector electrically between the high voltage AC power source and a high voltage side of the at least one transformer to provide lightning and transient voltage and current protection to the at least one transformer.

9. The pump-off control assembly as defined in claim 3, further comprising:

at least one circuit overload protector electrically between the lower voltage side of the at least one transformer and the first bridge rectifier to provide lightning and transient voltage and current protection to the at least one transformer and the first bridge rectifier.

10. The pump-off control assembly as defined in claim 1, further comprising:

a motor control panel for housing the first signal converter and the fourth signal converter; and a pump-off control panel for housing the pump-off controller, the pump-off control panel being electrically isolated from the motor control panel.

11. The pump-off control assembly as defined in claim 1, further comprising:

at least one circuit overload protector electrically between the at least one sensor and the first signal converter to provide lightning and transient voltage and current protection to the first signal converter and the at least one sensor.

12. The pump-off control assembly as defined in claim 1, further comprising:

a solar panel to power the pump-off controller.

13. The pump-off control assembly as defined in claim 12, further including:

a battery to provide backup power to the pump-off controller, the battery being recharged by the solar panel.

14. A method of controlling a prime mover which powers a pumping unit of a pumping system for pumping fluid from a well, the method comprising:

providing a power source to power the prime mover;

controlling the power to the prime mover with a controller;

sensing operating characteristics of the pumping system with at least one sensor;

transmitting an electrical first signal from the at least one sensor to a first signal converter;

converting the electrical first signal to an optical second signal;

transmitting the optical second signal to a second signal converter through a first fiber optic cable;

converting the optical second signal to an electrical third signal;

processing the electrical third signal and outputting an electrical fourth signal to a third signal converter;

converting the electrical fourth signal to an optical fifth signal;

transmitting the optical fifth signal through one of the first fiber optic cable and a second fiber optic cable;

converting the optical fifth signal to an electrical sixth signal;

amplifying the electrical sixth signal to generate an amplified electrical seventh signal; and transmitting the amplified electrical seventh signal to regulate the controller.

15. The method of controlling the prime mover as defined in claim 14, further comprising:

providing a high voltage AC power source;

normally transmitting the high voltage AC power to the prime mover through a selectively operable motor contactor to control the power to the prime mover;

controlling a motor relay in response to the electrical seventh signal; and transmitting an electrical eighth signal from the motor relay to selectively operate the selectively operable motor contactor.

16. The method of controlling the prime mover as defined in claim 15, further comprising:

transforming a portion of the high voltage AC power to a low voltage AC power with at least one transformer.

17. The method of controlling the prime mover as defined in claim 16, further comprising:

rectifying a portion of the low voltage AC power to provide a first substantially DC current to drive an oscillator;

generating a second substantially AC current with the oscillator to drive an electrical isolation transformer; and rectifying the second substantially AC current to provide substantially DC current to the at least one sensor.

18. The method of controlling the prime mover as defined in claim 17, further comprising:

regulating voltage to the oscillator; and regulating voltage to the electrical isolation transformer.

19. The method of controlling the prime mover as defined in claim 14, further comprising:

transforming the high voltage AC power to a medium AC voltage source; and transforming the medium AC voltage source to the low AC voltage source.

20. The method of controlling the prime mover as defined in claim 14, further comprising:

providing lightning and transient voltage and current protection electrically between the high voltage AC power source and a high voltage side of at least one transformer.

21. The method of controlling the prime mover as defined in claim 14, further comprising:

powering a pump-off controller for processing the third electrical signal with a solar panel.

22. The method of controlling the prime mover as defined in claim 16, further comprising:

powering a pump-off controller for processing the third electrical signal with the low voltage AC power.

* * * * *